US006608546B2

(12) United States Patent
Andoh et al.

(10) Patent No.: US 6,608,546 B2
(45) Date of Patent: Aug. 19, 2003

(54) FUSE AND FUSE SUPPORT

(75) Inventors: Hideki Andoh, Ogaki (JP); Akihiko Shimizu, Southfield, MI (US)

(73) Assignee: Pacific Engineering Corp., Gifu-ken (JP)

( * ) Notice: Subject to any disclaimer, the term of this patent is extended or adjusted under 35 U.S.C. 154(b) by 49 days.

(21) Appl. No.: 09/794,196

(22) Filed: Feb. 26, 2001

(65) Prior Publication Data

US 2002/0044038 A1 Apr. 18, 2002

(30) Foreign Application Priority Data

Mar. 3, 2000 (JP) ..... 2000-058691

(51) Int. Cl.[7] ..... H01H 85/00; H01H 85/143

(52) U.S. Cl. ..... 337/260; 337/4; 337/142; 337/186; 337/227; 337/380; 439/621

(58) Field of Search ..... 337/1, 4, 14, 142, 337/186, 227, 260, 380; 439/76.1, 621, 623

(56) References Cited

U.S. PATENT DOCUMENTS 3,909,767 A * 9/1975 Williamson et al. ..... 337/198
4,224,592 A * 9/1980 Urani et al. ..... 29/623
4,499,447 A * 2/1985 Greenberg ..... 337/241
5,179,503 A * 1/1993 Fouts et al. ..... 307/10.1
5,215,479 A * 6/1993 Araki et al. ..... 174/186
5,403,193 A * 4/1995 Ito et al. ..... 439/34
5,734,125 A * 3/1998 Yasukuni et al. ..... 174/52.2

FOREIGN PATENT DOCUMENTS

| | | |
|---|---|---|
| CH | 38173 | 7/1906 |
| DE | 475943 | 5/1929 |
| DE | 2722008 | 11/1978 |
| DE | 19705242 | 8/1998 |
| EP | WO96/13847 | 5/1996 |
| GB | 621316 | 4/1949 |
| GB | 677648 | 8/1952 |
| GB | 2002603 | 2/1979 |
| GB | 2233512 A | 1/1991 |
| JP | 2000011850 | 6/1998 |

* cited by examiner

*Primary Examiner*—Jayprakash N. Gandhi
(74) *Attorney, Agent, or Firm*—Sheridan Ross P.C.

(57) ABSTRACT

A 42V fuse and a fuse support used in an electric circuit of an automobile. The 42V fuse includes first and second terminals, a fuse line connecting the first and second terminals, and a housing. The fuse support has a pair of guide blocks. A groove extends through each block. The grooves enable the 42V fuse to be connected to the fuse support. Further, the grooves restrict the connection of a 14V fuse to the fuse support.

16 Claims, 5 Drawing Sheets

FUSE AND FUSE SUPPORT

BACKGROUND OF THE INVENTION

The present invention relates to a fuse, and more particularly, to a fuse and fuse support of an automobile electric circuit.

The electric wires of electric devices installed in automobiles lead to a fuse box. The fuse box accommodates fuses, each of which corresponds to the capacity of the associated electric device. The electric wires are connected to a battery via fuses and switches, such as an ignition switch. Each fuse melts when excessive current flows through the fuse. This protects the associated electric device from the excessive current.

A typical electric system of an automobile generates 14V and stores 12V. That is, an alternator generates 14V, and a battery stores 12V. In such electric system, the rated voltage of a fuse is 32V and the breaking characteristic of a fuse is 32V×1000 A (rated voltage×rated breaking current).

However, the number of electronic controllers installed in automobiles has been increasing recently. Thus, the power supply capacity of a system that generates 14V and stores 12V has become insufficient. As a result, it is predicted that systems generating 42V and storing 32V will be employed in lieu of conventional systems. Accordingly, a fuse having a rated voltage greater than 42V will be necessary for the 42V generation systems. Further, it can be predicted that a system that generates 14V and stores 12V may be used together with a system that generates 42V and stores 32V.

The dimension of a fuse is substantially determined in accordance with an automobile industry standard. Thus, when a system that generates 14V and stores 12V is used together with a system that generates 42V and stores 32V, a 14V fuse may inadvertently be installed in the 42V system.

If, for example, a 14V system fuse (14V fuse) is inadvertently installed in a 42V system, excessive current would melt the 14V fuse. Subsequent to the melting of the 14V fuse, the insulation resistance of the 14V fuse would become insufficient and cause an arc discharge. When an arc discharge continues, the synthetic resin housing of the fuse may melt.

To prevent arc discharge, arc-extinguishing sand may be contained in a fuse. However, this would enlarge the fuse and, in turn, enlarge the fuse box that holds the fuse.

SUMMARY OF THE INVENTION

It is an object of the present invention to provide a fuse and fuse support that prevents erroneous installation.

To achieve the above object, the first aspect of the present invention provides a fuse including two substantially parallel terminals, each terminal having a distal end and a basal end, a fuse line connecting the two terminals, and a housing for accommodating the basal ends of the two terminals and the fuse line. The terminals lie in an imaginary plane. The housing includes a front surface and a rear surface, which is generally parallel to and spaced from the front surface. The thickness of the fuse, as measured in a direction that is perpendicular to the imaginary plane, is substantially less than four millimeters at a location that includes at least one lateral edge of the fuse such that the at least one lateral edge fits within a fuse guide that has a matching dimension.

The second aspect of the present invention provides a fuse including two substantially parallel terminals, each terminal having a distal end and a basal end, a fuse line connecting the two terminals, and a housing for accommodating the basal ends of the two terminals and the fuse line. The terminals lie in an imaginary plane. The width of at least one of the terminals, as measured in a lateral direction along the imaginary plane, is substantially less than 2.8 millimeters.

The third aspect of the present invention provides a fuse support for accommodating a first fuse, which is rated at a first voltage, and for blocking a second fuse, which is rated at a second voltage. The first voltage is higher than the second voltage. The fuse support includes a restriction member for preventing reception of the second fuse in the fuse support.

The fourth aspect of the present invention provides a circuit protection assembly for accommodating a first fuse and for blocking a second fuse. The first fuse is rated at a first voltage and the second fuse is rated at a second voltage, the first voltage being higher than the second voltage. The assembly includes the first fuse and a support for receiving the first fuse. The first fuse includes two substantially parallel terminals, wherein each terminal has a distal end and a basal end, and wherein the terminals lie in an imaginary plane; a fuse line connecting the two terminals; and a housing for accommodating the basal ends of the two terminals and the fuse line. The housing includes a front surface and a rear surface, the rear surface being generally parallel to and spaced from the front surface. The thickness of the fuse, as measured in a direction that is perpendicular to the imaginary plane, is substantially less than four millimeters at a location that includes at least one lateral edge of the fuse. The support includes a restriction member for permitting the connection of the first fuse and for blocking the second fuse. The restriction member including a pair of guide blocks for guiding the first fuse. At least one of the guide blocks has a guide groove, one dimension of which is substantially equal to the thickness of the first fuse.

The fifth aspect of the present invention provides a circuit protection assembly for accommodating a first fuse and for blocking a second fuse, wherein the first fuse is rated at a first voltage and the second fuse is rated at a second voltage, the first voltage being higher than the second voltage. The assembly includes the first fuse and a socket for receiving one of the terminals of the first fuse. The first fuse includes two substantially parallel terminals, a fuse line connecting the two terminals, and a housing. Each terminal has a distal end and a basal end, and the terminals lie in an imaginary plane, and the width of one terminal, as measured in a lateral direction along the imaginary plane, is substantially less than 2.8 millimeters. The housing accommodates the basal ends of the terminals and the fuse line. The socket has a dimension that is substantially the same as the width of the one terminal of the first fuse.

Other aspects and advantages of the present invention will become apparent from the following description, taken in conjunction with the accompanying drawings, illustrating by way of example the principles of the invention.

DETAILED DESCRIPTION OF THE PREFERRED EMBODIMENTS

Figure 1A:
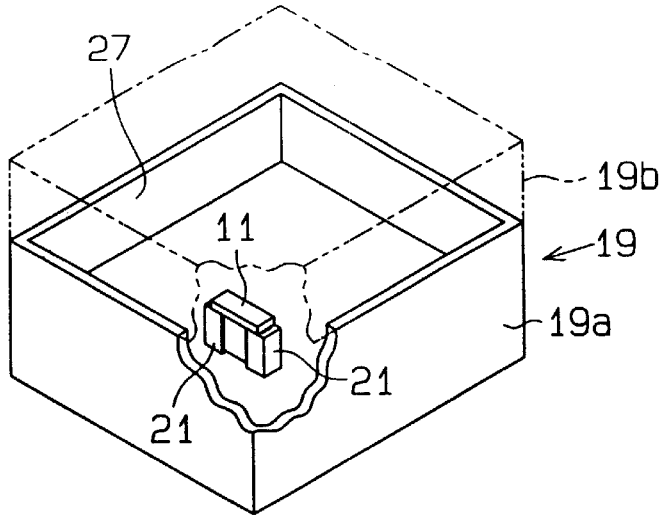
FIG. 1*a* is a schematic perspective view showing a 42V fuse box according to a first embodiment of the present invention.

A fuse 11 and a fuse support, or fuse box 19, according to a first embodiment of the present invention will now be described with reference to FIGS. 1 to 5. In the drawings, like numerals are used for like elements throughout.

As shown in FIG. 1*a*, the fuse box 19, which is used in a 42V system, includes a frame 19*a* and a cover 19*b*. A fuse compartment 27 is defined in the frame 19*a*. Pairs of guide blocks 21 (only one pair shown) are arranged in the frame 19*a*. A blade fuse (42V fuse) 11 is fitted between each pair of guide blocks 21.

Figure 1B:
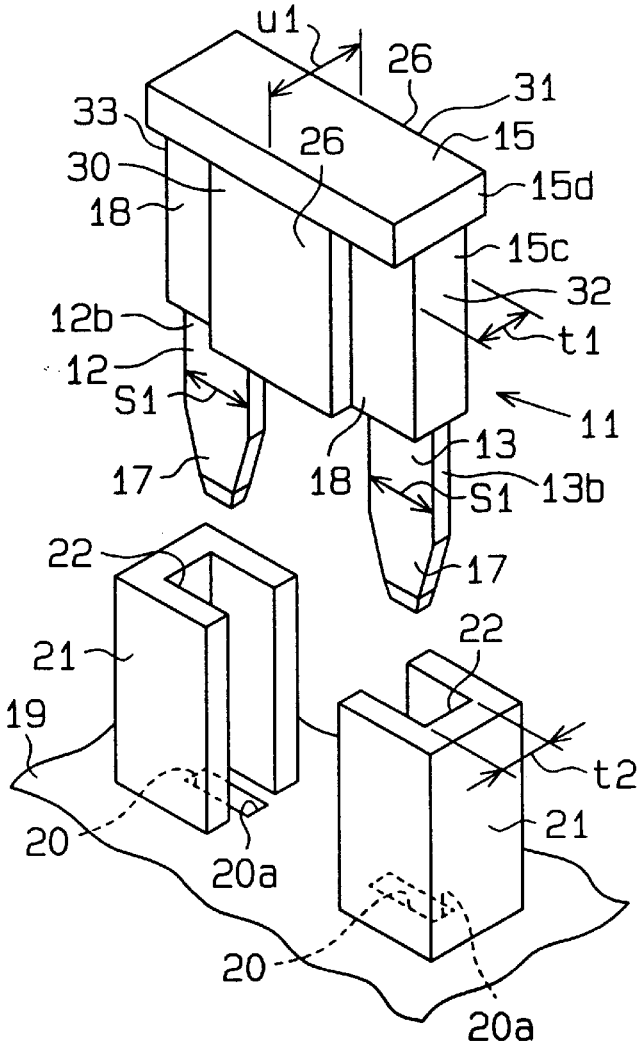
FIG. 1*b* is an exploded and enlarged perspective view showing the 42V fuse box and 42V fuse of FIG. 1*a;*
Figure 2:
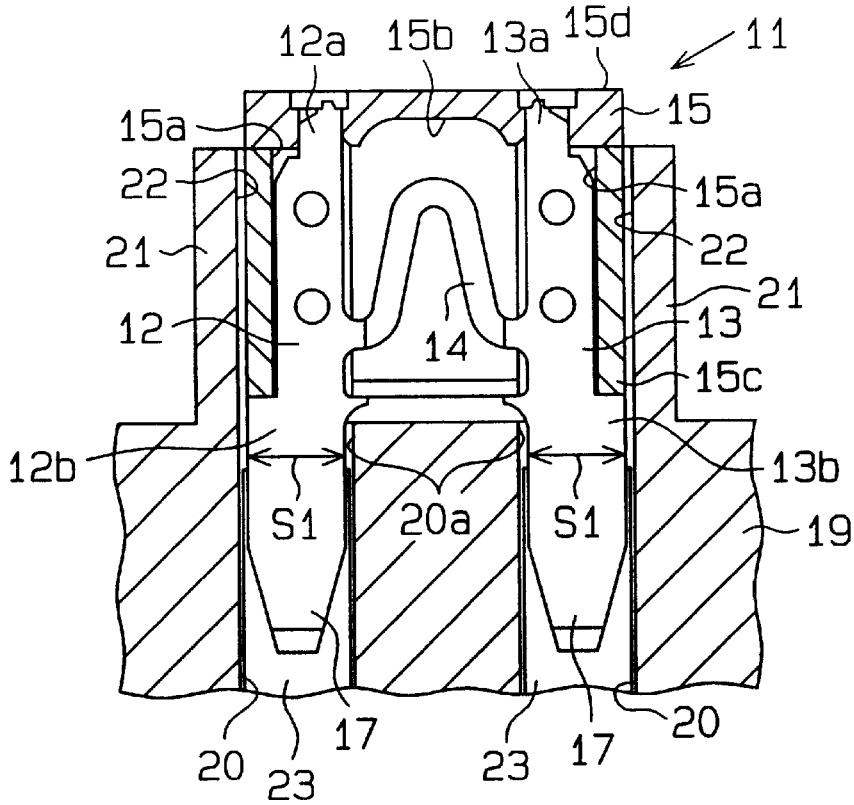
FIG. 2 is a cross-sectional view of the fuse and fuse box of FIG. 1*b;*

Referring to FIGS. 1*b* and 2, the 42V fuse 11 has an input terminal 12, an output terminal 13, a fuse line 14, which connects the two terminals 12, 13, and a housing 15, which covers the fuse line 14.

The housing 15 has a thin profile and is preferably made of a heat resistant and transparent synthetic resin. The housing 15 includes a plate-like head 15*d* and a body 15*c*, which is formed integrally with the head 15*d*. An internal space is defined in the body 15*c*. The internal space includes terminal receptacles 15*a* and a fuse line receptacle 15*b*. The fuse line receptacle 15*b* receives the fuse line 14.

The input terminal 12 and the output terminal 13 respectively have basal ends 12*a*, 13*a*, which are fixed to the corresponding terminal receptacles 15*a*, and distal ends 12*b*, 13*b*, which project from the housing 15. The distal ends 12*b*, 13*b* each have a substantially uniform thickness. The width S1 of the terminals 12, 13 is 2.8±0.2 mm to comply with automobile industry standards. Each of the distal ends 12*b*, 13*b* has a tapered portion 17. The remaining part of each of the distal ends 12*b*, 13*b* is straight. Each tapered portion 17 becomes narrower as the distance from the basal ends 12*a*, 13*a* increases.

The curved fuse line 14 connects the basal end 12*a* of the input terminal 12 with the basal end 12*a* of the output terminal 13. The input terminal 12, the output terminal 13, and the fuse line 14 are formed integrally by punching a metal sheet.

Figure 3:
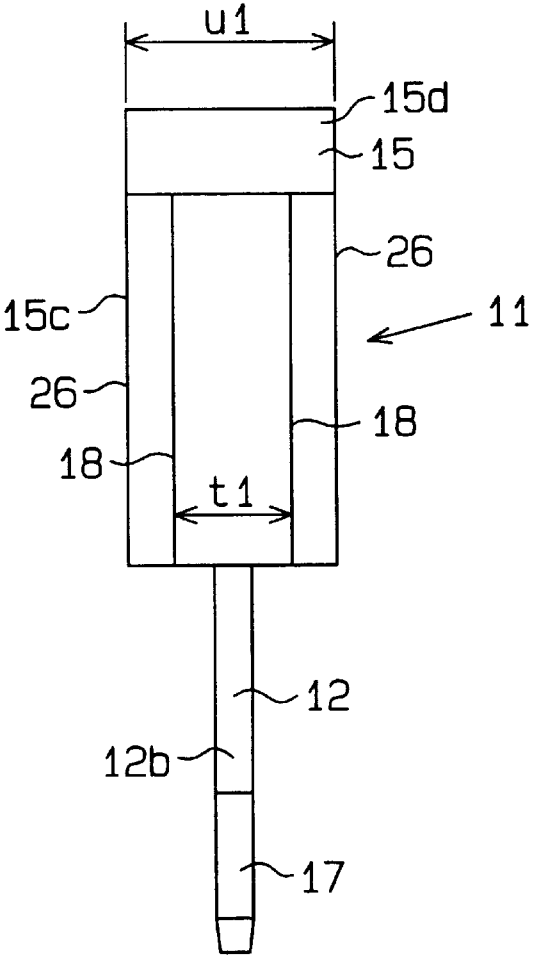
FIG. 3 is a side view of the fuse of FIG. 1*b;*
Figure 4:
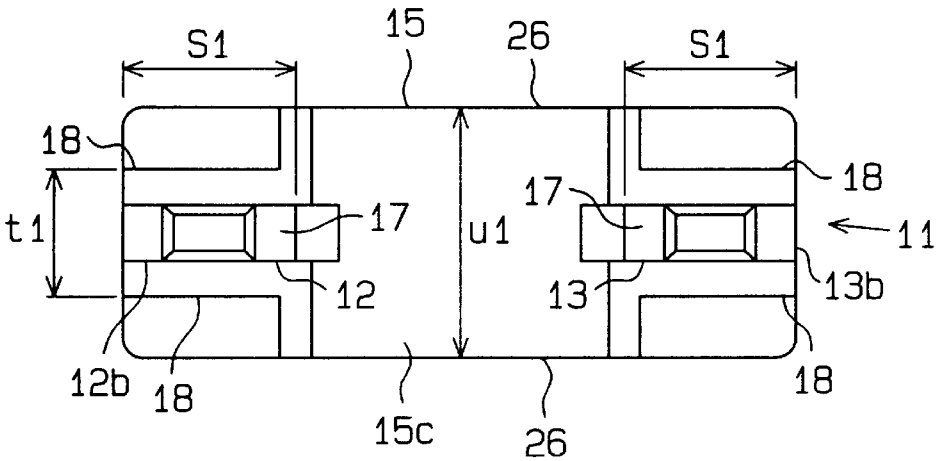
FIG. 4 is a bottom view showing the fuse of FIG. 1*b;*

The form of the housing 15 will now be described. Referring to FIGS. 1*b*, 3, and 4, the body 15*c* has relatively wide front and rear walls 30, 31 and relatively narrow right and left walls 32, 33. The front and rear walls 30, 31 each have two stepped portions 18 and a thin projection 26 located between the stepped portions 18. Each stepped portion 18 is flat and extends in the longitudinal direction of the input and output terminals 12, 13. As shown in FIG. 4, the thickness u1 of the body 15*c* at where the projection 26 (thick portion) is located is about four millimeters to comply with automobile industry standards. The thickness t1 of the body 15*c* where each stepped portion 18 is located is less than the thickness u1 of the thick portion.

The input terminal 12 and the output terminal 13 are each fitted into a socket 20, which extends into the 42V fuse box 19. Each socket 20 accommodates an electrode 23 (FIG. 2) connected to a battery and an electric device (neither shown). The input terminal 12 and the output terminal 13 are electrically connected to the associated electrode 23. The battery has the capability to supply 42V and to store 32V.

The guide blocks 21 are formed to surround an opening 20*a* of each socket 20. A guide groove 22 extends through each guide block 21. The width t2 of the guide groove 22 is substantially the same as the thickness t1 of the housing 15 at the stepped portion 18. The opposing pair of guide blocks 21 supports the 42V fuse 11.

Figure 5:
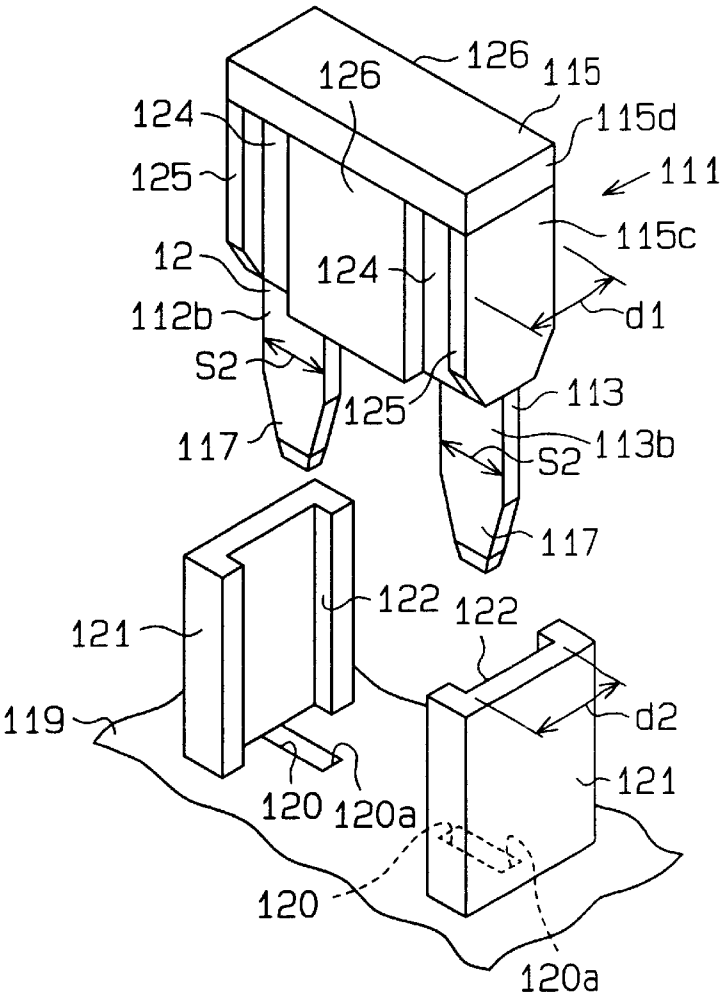
Fig.5 (Prior Art)
FIG. 5 is a schematic perspective view showing a prior art 14V fuse box and a 14V fuse.

The differences between a typical 14V fuse 111 used in a system that generates 14V and stores 12V and the 42V fuse 11 will now be discussed. As shown in FIG. 5, the 14V fuse 111 has an input terminal 112 and an output terminal 113. Basal ends of the input and output terminals 112, 113 are accommodated in a housing 115. The housing 115 has a body 115*c* with a front wall 30 and a rear wall 31, each of which includes a thin projection 126, two side walls 125, and two channels 124. The channels 124 extend in the longitudinal direction of the input and output terminals 112, 113. The thickness d1 of the body 15*c* where each side wall 125 is formed is about four millimeters to comply with automobile industry standards. Thus, the width d1 of the side walls 125 is substantially the same as the thickness u1 at the thick portion of the 42V fuse 11.

Pairs of guide blocks 121 (only one pair shown) for the 14V fuses 111 are formed on a 14V fuse box 119. A guide groove 122 extends along each guide block 121. The width d2 of the guide groove 122 is substantially the same as the width d1 of the side walls 125. The width s2 of the input and output terminals 112, 113 is 2.8±0.2 mm. The dimensions of the other parts of the 14V fuse 111 are substantially the same as the corresponding parts of the 42V fuse 11.

The electric characteristics of the 42V fuse and the 14V fuse 111 will now be discussed. The rated voltage of the 42V fuse 11 is 55V and the breaking characteristic of the 42V fuse is 55V×1000 A (rated voltage×rated breaking current). The fusion time of the 14V fuse 111 is substantially the same as that of the 42V fuse 11. The fusion time refers to the time required for the fuse line 14 to melt when an excessive current, which is greater than a predetermined current value, flows through the fuse line 14.

An example of the relationship between the rated current and the fusion time of the fuse line 14 will now be discussed. The fuse line 14 is capable of withstanding a current corresponding to 110% of the rated current for over 100 hours. The fuse line 14 melts within 0.75 to 1,800 seconds when a current corresponding to 135% of the rated current flows through the fuse line 14. The fuse line 14 melts within 0.15 to 5 seconds when a current corresponding to 200% of the rated current flows through the fuse line 14. The fuse line 14 melts within 0.04 to 0.5 seconds when a current corresponding to 350% of the rated current flows through the fuse line 14. The fuse line 14 melts within 0.02 to 0.2 seconds when a current corresponding to 600% of the rated current flows through the fuse line 14.

The connection of the 42V fuse 11 to the 42V fuse box 19 will now be discussed. The stepped portions 18 (narrow portions) of the 42V fuse 11 are each engaged with the guide groove 22 of the corresponding guide block 21. The 42V fuse 11 is moved along the guide grooves 22 until the distal ends 12*b*, 13*b* are fit into the associated sockets 20. This connects the distal ends 12*b*, 13*b* to the electrodes 23.

The guide grooves 22 serve to facilitate the connection of the 42V fuse 11. Further, the connected 42V fuse 11 is supported by the guide block 21, which prevents the 42V fuse 11 from falling.

Since the width t2 of the guide grooves 22 is less that the width d1 of the side walls 125 of the 14V fuse 111, the guide blocks 21 prevent the connection of the 14V fuse 111. This prevents the 14V fuse 111 from being inadvertently connected to the 42V fuse box 19.

On the other hand, the 42V fuse 11 may be connected to the 14V fuse box 119. The width d2 of the guide grooves 122 of the guide blocks 121 is greater than the thickness t1 of the narrow portion of the 42V fuse 11. This permits the 42V fuse 11 to be received by the pair of the guide blocks 121. Further, the 42V fuse 11 and the 14V fuse 111 are formed so that the terminal widths s1, s2, the terminal thickness, and the distance between the terminals 12, 13 and 112, 113 comply with the same standard. Thus, the 42V fuse 11 may easily be inserted into the sockets 120 and connected with electrodes (not shown) of the 14V system.

If the 42V fuse 11 is used in lieu of the 14V fuse 111, excessive current melts the fuse line 14 of the 42V fuse 11 within a predetermined time. Thus, the employment of the 42V fuse 11 does not cause problems. Further, since the rated voltage of the 42V fuse 11 is greater than the voltage of the 14V system, an arc is not formed when the 42V fuse 11 is being used.

The first embodiment has the advantages described below.

(1) The thickness t1 of the stepped portions 18 of the 42V fuse 11 is less than the width d1 of the side walls 125 of the 14V fuse 111. The dimensional difference between the stepped portions 18 and the side walls 125 prevent erroneous connection of the 14V fuse 111 to the guide blocks 21 of the 42V fuse 11.

(2) The thickness t1 of the narrow portion of the 42V fuse 11 is less than the width d1 of the side walls of the fuse 111 and the width d2 of the guide grooves 122. The remaining parts of the 42V fuse 11 and the 14V fuse 111 have substantially the same dimensions. Thus, the 42V fuse 11, which has a large rated voltage, is easily connected to the 14V fuse box 119.

(3) The fusion time of the 42V fuse 11 relative to current exceeding the rated current of the fuse line 14 is substantially the same as that of the 14V fuse 11. Thus, the 42V fuse 11 may be used on the 14V fuse box 119.

(4) The width t2 of the guide grooves 22 in the 42V fuse box 19 is less than the width d2 of the guide grooves 122 in the 14V fuse box 119. This easily prevents erroneous connection of the 14V fuse 111, which is now widely used, to the 42V fuse box 19.

Figure 7:
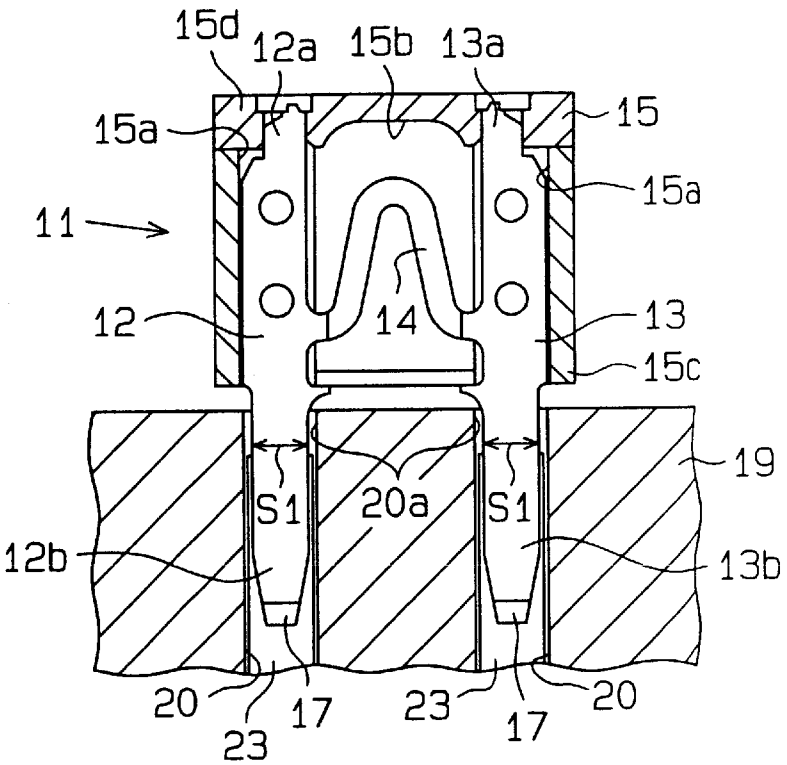
FIG. 7 is a cross-sectional view showing the fuse and fuse box of FIG. 6.
Figure 8:
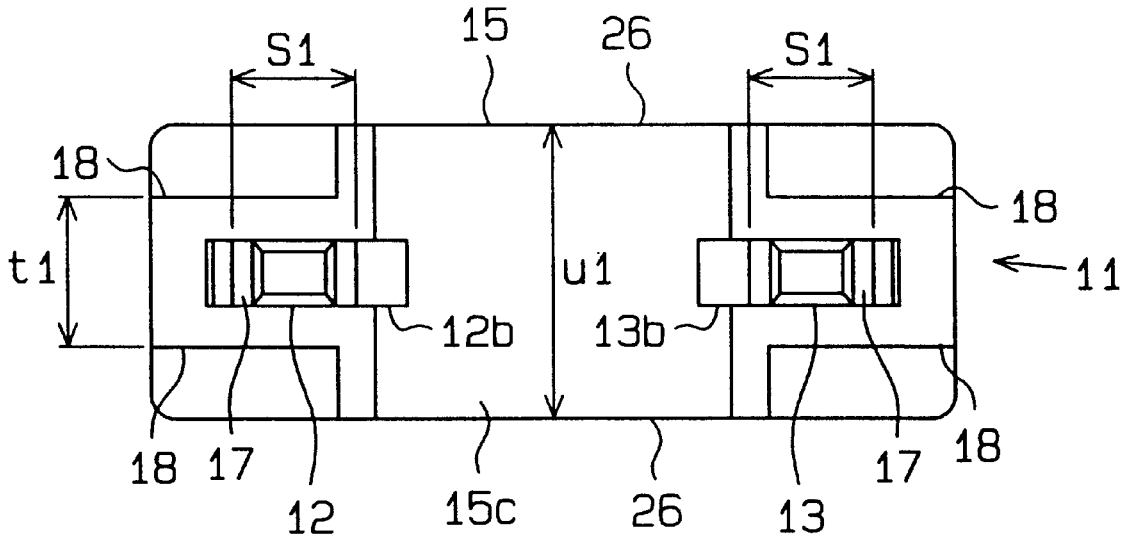
FIG. 8 is a bottom view showing the fuse of FIG. 6.

A fuse 11 and a fuse box 19 according to a second embodiment of the present invention will now be discussed with reference to FIGS. 6 to 8. The input terminal 12 and the output terminal 13 of the 42V fuse 11 have a width s1 that is less than the terminal width s2 of the 14V fuse 111 of FIG. 5. Thus, the width s2 is less than 2.8±0.2 mm. In accordance with the narrow terminals 12, 13, the sockets 20 of the 42V fuse box 19, or the size of the openings 20*a*, is smaller than the size of the opening 120*a* of the 14V fuse box 119 of FIG. 5. The relatively small sockets 20 prevent erroneous connection of the 14V fuse 111. The guide blocks 21 are eliminated in the second embodiment.

The connection of the 14V fuse 111 to the 42V fuse box 19 will now be discussed. Since the terminals 112, 113 of the 14V fuse 111 are larger than the sockets 20 in the 42V fuse box 19, insertion of the terminals 112, 113 into the sockets 200 is prevented. This prevents connection of the 14V fuse 111 to the 42V fuse box 19.

The connection of the 42V fuse 11 to the 14V fuse box 119 will now be discussed. Since the terminals 12, 13 of the 42V fuse 11 are smaller than the sockets 120 of the 14V fuse box 119, the 42V fuse 1 are easily connected to the 14V fuse box 119.

The second embodiment has the advantages described below.

(5) The terminals 12, 13 of the 42V fuse 11 and the opening 20*a* of each socket 20 in the 42V fuse box 19 are smaller than the terminals 112, 113 of the 14V fuse 111. This restricts the insertion of the 14V fuse 111 into the sockets 20 of the 42V fuse box 19.

(6) The terminals 12, 13 of the 42V fuse 11 are smaller than the opening 120*a* of each socket 120 in the 14V fuse box 119. Thus, the 42V fuse 11, the rated voltage of which is high, is easily connected to the 14V fuse box 119.

(7) The opening 20*a* of each socket 20 in the 42V fuse box 19 is narrower than the terminals 112, 113 of the 14V fuse 111. This easily prevents erroneous connection of the 14V fuse 111, which is now widely used, to the 42V fuse box 19.

(8) The 42V fuse 11 includes the stepped portions 18 and the narrow terminals 12, 13. Thus, the 42V fuse 11 may easily be connected to, for example, the 42V fuse box 19 of FIG. 1*b* and the 42V fuse box 19 of FIG. 6.

It should be apparent to those skilled in the art that the present invention may be embodied in many other specific forms without departing from the spirit or scope of the invention. Particularly, it should be understood that the present invention may be embodied in the following forms.

Figure 6:
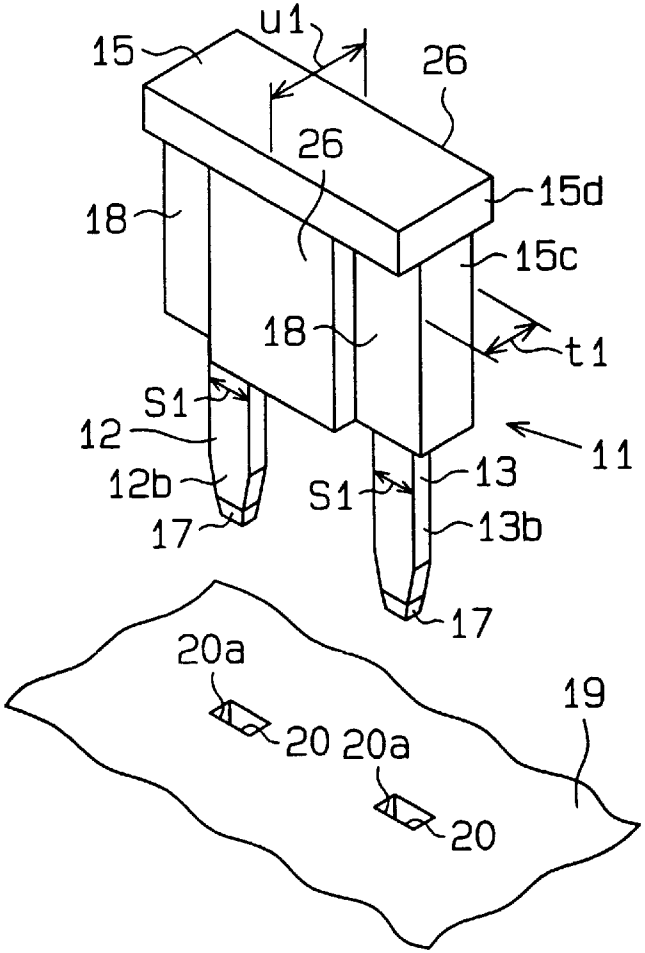
FIG. 6 is a schematic view showing a 42V fuse and fuse box according to a second embodiment of the present invention.

In the second embodiment, the guide blocks 21 shown in FIG. 1*b* may be arranged about the sockets 20 of FIG. 6. This facilitates the connection of the 42V fuse 11 to the sockets 20 and prevents the connected 42V fuse 11 from falling.

In the second embodiment, the guide blocks 121 of FIG. 5 may be arranged about the sockets 20 of FIG. 6, and the side walls 125 of the 14V fuse 111 may be formed on the 42V fuse 11. In such case, the relatively small sockets 20 prevent the connection of the 14V fuse 111. Further, a common housing may be used for the 42V fuse 11 and the 14V fuse 111.

In the first and second embodiments, the rated voltage of the 42V fuse 11 does not have to be 55V as long as it is higher than 42V, such as 50V or 45V.

In the first embodiment, the width s1 of the stepped portions 18 may be narrower or wider as long as the left and right walls 32, 33 have the width s1.

In the first embodiment, the projection 26 of the 42V fuse may be eliminated. In other words, the front and rear walls 30, 31 of the housing 15 may be flat, and the body 15*c* may have a uniform thickness u1, which is equal to the thickness t1 of the narrow portion.

The present examples and embodiments are to be considered as illustrative and not restrictive, and the invention is not to be limited to the details given herein, but may be modified within the scope and equivalence of the appended claims.

What is claimed is:

1. A 42 volt blade fuse for use in an electric circuit of a vehicle, comprising:

two substantially parallel terminals, wherein each terminal has a distal end and a basal end, and wherein the terminals lie in an imaginary plane;

a fuse line connecting the two terminals; and a housing for accommodating the basal ends of the two terminals and the fuse line, wherein the housing includes:

a front surface;

a rear surface, which is generally parallel to and spaced from the front surface; and a head which connects the front surface and the rear surface at an upper end of the fuse, wherein a thickness of the fuse, as measured in a direction that is perpendicular to the imaginary plane, is substantially less than four millimeters at a location that includes at least one lateral edge of the fuse such that the at least one lateral edge fits within a fuse guide that has a matching dimension, and wherein the head of the 42V fuse has a size that is substantially identical to a size of a head of a 14V fuse.

2. The fuse according to claim 1, wherein the housing has a first side surface and a second side surface, the second side surface being opposite to the first side surface, wherein the side surfaces connect the front surface to the rear surface at opposite sides of the fuse, respectively.

3. The fuse according to claim 2, wherein the side surfaces are parallel.

4. The fuse according to claim 3, wherein a dimension of the side surfaces that is measured in a direction perpendicular to the imaginary plane is equal to the thickness of the fuse.

5. The fuse according to claim 1, wherein the front surface includes a central front projection, and the rear surface includes a central rear projection, and the thickness of the fuse is approximately four millimeters at a central part of the fuse that corresponds to the projections.

6. The fuse according to claim 5, wherein the housing includes a head at the top of the fuse, wherein the head connects the front surface to the rear surface.

7. The fuse according to claim 1, wherein the location that includes at least one lateral edge of the fuse has no projections.

8. A 42 volt blade fuse for use in a vehicle electric circuit system that generates 42V, comprising:

two substantially parallel terminals, wherein each terminal has a distal end and a basal end, and wherein the terminals lie in an imaginary plane;

a fuse line connecting the two terminals; and a housing for accommodating the basal ends of the two terminals and the fuse line, wherein a width of at least one of the terminals, as measured in a lateral direction along the imaginary plane, is substantially less than 2.8 millimeters, wherein the housing includes a head which connects a front surface and a rear surface of the housing at an upper end of the fuse, and the head of the 42V fuse has a size that is substantially identical to a size of a 14V fuse.

9. A circuit protection assembly for accommodating a first fuse and for blocking a second fuse, wherein the first fuse is rated at a first voltage and the second fuse is rated at a second voltage, the first voltage being higher than the second voltage, the assembly comprising:

the first fuse, wherein the first fuse includes:

two substantially parallel terminals, wherein each terminal has a distal end and a basal end, wherein said terminals are separated by a first distance, and wherein the terminals lie in an imaginary plane;

a fuse line connecting the two terminals; and a housing for accommodating the basal ends of the two terminals and the fuse line, wherein the housing includes:

a front surface; and a rear surface, which is generally parallel to and spaced from the front surface, wherein a thickness of the first fuse, as measured in a direction that is perpendicular to the imaginary plane, is substantially less than four millimeters at a location that includes at least one lateral edge of the first fuse;

the second fuse, wherein the second fuse includes:

two substantially parallel terminals, wherein each terminal has a distal end and a basal end, wherein said terminals are separated by about said first distance, and wherein the terminals lie in an imaginary plane;

a fuse line connecting the two terminals; and a housing for accommodating the basal ends of the two terminals and the fuse line, wherein the housing includes:

a front surface; and a rear surface, which is generally parallel to and spaced from the front surface, wherein a thickness of the second fuse, as measured in a direction that is perpendicular to the imaginary plane, is substantially greater than 4 millimeters at a location that includes at least one lateral edge of the second fuse;

a support for receiving the first fuse, wherein the support includes a restriction member for permitting connection of the first fuse and for blocking the second fuse, the restriction member including a pair of guide blocks for guiding the first fuse, and wherein at least one of the guide blocks has a guide groove, one dimension of which is substantially equal to the thickness of the first fuse.

10. The circuit protection assembly according to claim 9, wherein the first fuse is a 42V blade fuse for use in an electric circuit of a vehicle and the second fuse is a 14V blade fuse.

11. A circuit protection assembly for accommodating a first fuse and for blocking a second fuse, wherein the first fuse is rated at a first voltage and the second fuse is rated at a second voltage, the first voltage being higher than the second voltage, the assembly comprising:

the first fuse, wherein the first fuse includes:

two substantially parallel terminals, wherein each terminal has a distal end and a basal end, and the terminals lie in an imaginary plane, wherein centerlines of the terminals are separated by a first distance, and wherein a width of one terminal, as measured in a lateral direction along the imaginary plane, is substantially less than 2.8 millimeters;

a fuse line connecting the two terminals; and a housing for accommodating the basal ends of the terminals and the fuse line;

the second fuse, wherein the second fuse includes:

two substantially parallel terminals, wherein each terminal has a distal end and a basal end, and the terminals lie in an imaginary plane, wherein centerlines of the terminals are separated by about said first distance, and wherein a width of one terminal, as measured in a lateral direction along the imaginary plane, is substantially greater than 2.8 millimeters;

a fuse line connecting the two terminals; and a housing for accommodating the basal ends of the terminals and fuse line;

a socket for receiving one of the terminals of the first fuse, wherein the socket has a dimension that is substantially the same as the width of the one terminal of the first fuse, and substantially less than the width of the one terminal of the second fuse.

12. The circuit protection assembly according to claim 11, wherein the first fuse is a 42V blade fuse for use in a vehicle electric circuit system that generates 42V and stores 32V and the second fuse is a 14V blade fuse for use in a vehicle electric circuit system that generates 14V and stores 12V.

13. A first fuse, which can replace a second fuse, wherein the first fuse is a 42V blade fuse for use in a vehicle electric circuit system that generates 42V and the second fuse is a 14V blade fuse for use in a vehicle electric circuit system that generates 14V, and a certain dimension of the first fuse is smaller than a corresponding dimension of the second fuse, the first fuse comprising:

two substantially parallel terminals, wherein each terminal has a distal end and a basal end, and wherein the terminals lie in an imaginary plane;

a fuse line connecting the two terminals; and a housing for accommodating the basal ends of the terminals and the fuse line, wherein the housing includes:

a front surface;

a rear surface generally parallel to and spaced from the front surface; and a head which connects the front surface and the rear surface at an upper end of the fuse, wherein the head has a size that is substantially identical to a size of a head of a 14V fuse, wherein the housing has a thickness, as measured in a direction that is perpendicular to the imaginary plane at a location that includes at least one lateral edge of the first fuse, that is substantially smaller than a corresponding thickness of the second fuse, wherein a first socket capable of receiving said first fuse cannot receive said second fuse, and wherein a second socket capable of receiving said second fuse is capable of receiving said first fuse.

14. The first fuse according to claim 13, wherein the front surface includes a central front projection, and the rear surface includes a central rear projection, and the thickness of the first fuse is approximately four millimeters at a central part of the fuse that corresponds to the projections.

15. The first fuse according to claim 14, wherein the housing includes a head at the top of the first fuse, wherein the head connects the front surface to the rear surface.

16. A first fuse, which can replace a second fuse, wherein the first fuse is a 42V blade fuse for use in a vehicle electric circuit system that generates 42V and the second fuse is a 14V blade fuse for use in a vehicle electric circuit system that generates 14V, and a certain dimension of the first fuse is smaller than a corresponding dimension of the second fuse, the first fuse comprising:

two substantially parallel terminals, wherein each terminal has a distal end and a basal end, and wherein the terminals lie in an imaginary plane;

a fuse line connecting the two terminals; and a housing for accommodating the basal ends of the two terminals and the fuse line, wherein the housing includes:

a front surface;

a rear surface generally parallel to and spaced from the front surface; and a head which connects the front surface and the rear surface at an upper end of the fuse, wherein the head has a size that is substantially identical to a size of a head of the second fuse, and wherein a width of at least one of the terminals, as measured in a lateral direction along the imaginary plane of the at least one of the terminals, is substantially smaller than a corresponding width of the second fuse.

* * * * *